US005265805A

United States Patent [19]

Artenian

[11] Patent Number: 5,265,805

[45] Date of Patent: Nov. 30, 1993

[54] ROTARY LANCE CLEANING APPARATUS

[76] Inventor: Steven M. Artenian, 15392 Alsace Cir., Irvine, Calif. 92714

[21] Appl. No.: 931,143

[22] Filed: Aug. 17, 1992

[51] Int. Cl.[5] ..... B05B 3/04; A47L 11/26

[52] U.S. Cl. ..... 239/135; 239/176; 239/754; 239/264; 239/288.5; 134/176

[58] Field of Search ..... 239/754, 722, 261, 264, 239/265, 288, 288.3, 288.5, 176, 135; 134/176, 179

[56] References Cited

U.S. PATENT DOCUMENTS

| | | | |
|---|---|---|---|
| 3,118,607 | 1/1964 | Rocher | 239/754 X |
| 4,191,589 | 3/1980 | Long | 134/176 X |
| 4,219,155 | 8/1980 | Goerss | 239/264 X |
| 4,903,364 | 2/1990 | Halls et al. | 239/754 X |

FOREIGN PATENT DOCUMENTS

| | | | |
|---|---|---|---|
| 275195 | 1/1990 | Fed. Rep. of Germany | 239/265 |

OTHER PUBLICATIONS

A-M-C Incorporated, Product literature/advertisement, Title: Turbo Twister.

*Primary Examiner*—Andres Kashnikow
*Assistant Examiner*—Lesley D. Morris
*Attorney, Agent, or Firm*—Price, Gess & Ubell

[57] ABSTRACT

An apparatus for cleaning large, flat hard surfaces such as concrete parking lots, sidewalks and plazas is provided The apparatus receives hot pressurized water and sprays the water downwardly onto the surface to be cleaned through a rotating manifold of spray nozzles. The manifold is mounted within a pushable cart or chassis, similar to a lawnmower chassis, for rotational movement in a plane parallel with the surface to be cleaned. Nozzles of the spray manifold are tilted at an angle such that water sprayed from the nozzles provides an angular momentum to the manifold. The apparatus is also provided with a mechanism for raising or lowering the height of the nozzles above the surface and for setting a minimum selected height.

24 Claims, 7 Drawing Sheets

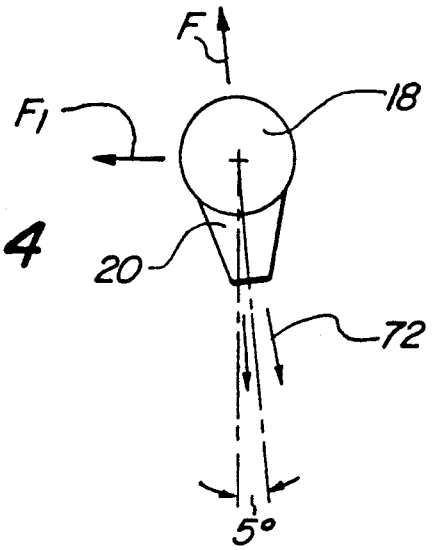
FIG. 4
FIG. 5
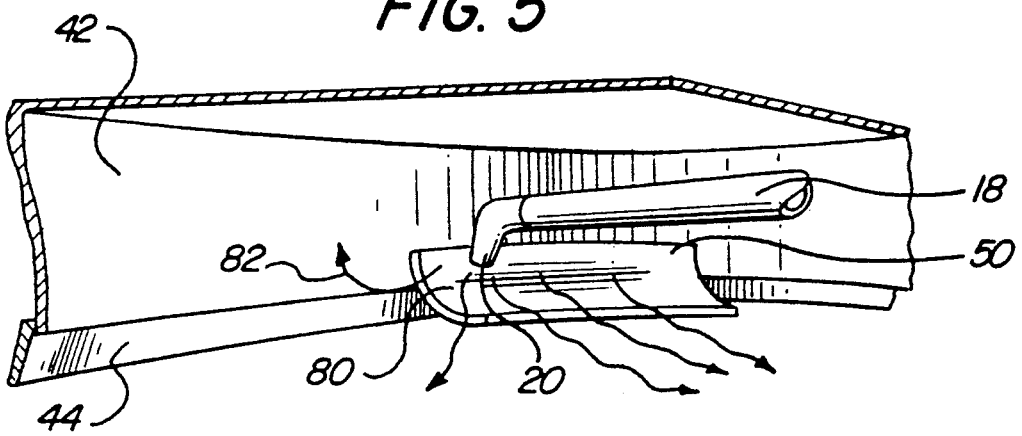
FIG. 6
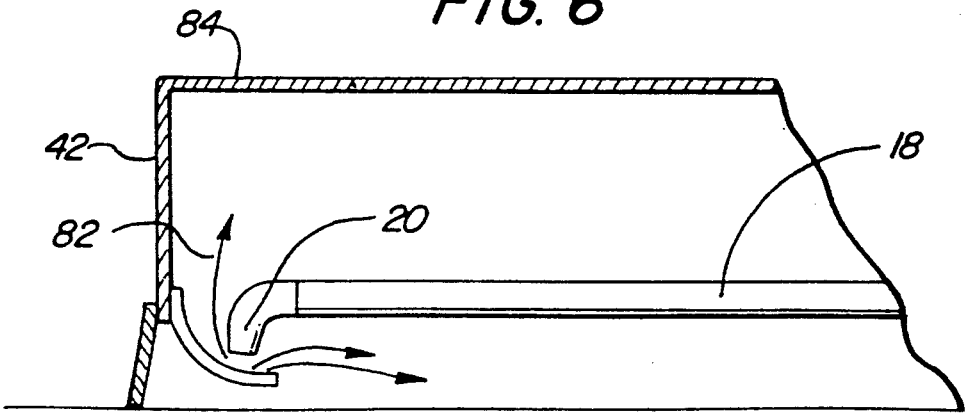

ROTARY LANCE CLEANING APPARATUS

BACKGROUND OF THE INVENTION

Field of the Invention

The invention relates generally to an apparatus for cleaning large, flat, hard surfaces such as parking lots, parking structures, or plaza sidewalks and the like.

Background of the Invention

It is periodically necessary to clean sidewalks, plazas and parking lots to remove dirt, grime, oil and other materials. Such periodic cleaning is particularly necessary in parking lots and parking structures where oil and other fluids drip from vehicles and create stains. Not only are such stains unsightly, but large oil stains present a safety problem as they can cause pedestrians to slip or cause vehicles to slide and lose traction. Moreover, within enclosed parking structures, a large number of oil stains, typically one per parking space, creates a generally noxious atmosphere which, in combination with exhaust fumes from vehicles, is a nuisance or health hazard.

Cleaning such surfaces, particularly oil stained surfaces, concrete or cement, has proved to be a particularly difficult problem. The rough and slightly porous surface of concrete tends to absorb materials such as oil, dirt and grime, such that the surface is extremely difficult to clean. The most effective method for cleaning such surfaces is to direct a high pressure jet of hot water directly onto the surface to "blast" the oil, dirt or grime out of the porous concrete. Typically, extremely hot water is employed in combination with various solvents provided for dispersing non-water soluble oils and greases. Conventionally, a cleaning lance or wand is employed. A cleaning lance includes a pistol grip, a long tube, and a nozzle and is connected to a high pressure hot water source via a hose. The pistol grip includes a trigger for manually actuating a valve to initiate or terminate a flow of hot pressurized water. When initiated, the hot pressurized water flows through the pistol grip, down the tube and out the nozzle in a high pressure jet stream. The lance is manually carried with the nozzle held close to the surface to be cleaned. Preferably, the outward spray of high pressure water has sufficient force to dislodge dirt, grime and oils covering the surface to be cleaned. In use, the nozzle is moved back and forth across the surface while the operator walks slowly across the surface. In this manner, a large surface of concrete is slowly cleaned.

As can be appreciated, the conventional cleaning technique employing a hand-held lance is an extremely laborious, slow and inefficient method for cleaning a large concrete surface, such as a parking lot or parking structure. At any moment, only a small surface of the concrete is cleaned by the action of the high pressure water stream. To clean a large surface of concrete, the lance must be slowly moved across the entire large surface to allow the relatively narrow, high pressure water to clean each portion of the surface. The lance is difficult to hold or control because of the high pressure stream of water. Further, because the water is typically at an extremely hot temperature, the environment in which the operator works soon becomes hot and humid. Moreover, solvents mixed with the high pressurized water may make breathing difficult. For these and other reasons, extreme operator fatigue occurs, and the efficiency at which a large area of concrete can be cleaned is extremely minimal. Because of fatigue and harsh conditions, an operator of the lance is tempted to skip over portions of the concrete which should be fully cleaned. Moreover, as the lance or wand is moved back and forth laterally, the level at which the nozzle is positioned above the concrete surface changes constantly resulting in uneven cleaning. With a conventional lance or wand cleaning system, typically only 2000 sq. feet can be effectively cleaned per hour. Because of operator fatigue, only about 10,000 sq. feet can be effectively cleaned in an 8 hour shift, 12 parking spaces can be cleaned per hour.

As can be appreciated, there exists a need to provide an improved device or apparatus for cleaning hard flat surfaces such as concrete, granite and the like. Although attempts have been made to improve upon the conventional lamps or wand cleaning apparatus, such attempts have not achieved a simple efficient, reliable, inexpensive and easy to use apparatus.

SUMMARY OF THE INVENTION

Therefore, it is an object of the invention to provide an improved device or apparatus for cleaning hard, flat surfaces such as concrete or granite surfaces in an efficient and inexpensive manner. This object, and the general purposes of the invention, may be achieved by the provision of a rotary lance cleaning apparatus which includes a pushable or moveable cart provided with a manifold of rotating spray lances which are positioned above a surface to be cleaned for movement and rotation above the surface. The pushable or moveable cart includes a frame mounted on a set of wheels such that the cart can be easily manually pushed across the surface to be cleaned. The pushable or moveable cart is connected to a water pressure source via a tube or conduit. The water pressure source provides a flow of pressurized, preferably hot, water. The tube or conduit which carries the flow of pressurized water is mounted to the top portion of a rotation union. A manifold of tubes or individual lances is mounted into a lower portion of the union. which rotates freely with respect to the top portion of the union. The flow of pressurized water is conveyed through the union into the manifold of tubes and is sprayed downwardly through nozzles mounted at the ends of each tube. The tubes are mounted parallel with respect to the surface to be cleaned. Each of the nozzles is oriented at a slight angle from the vertical above the surface to be cleaned. Because of the angle, a high pressure stream of water ejected from the nozzles generates an angular rotation force which causes the manifold of tubes to spin. With the manifold of tubes spinning, the individual nozzles are carried over the surface to be cleaned in a circular arc thereby cleaning a ring-shaped portion of concrete upon each rotation of the manifold. In use, while the manifold is spinning, an operator pushes the cart across the surface to be cleaned such that a large swath of concrete is efficiently cleaned. Thus, the cleaning apparatus of the invention operates in a manner generally analogous to a lawnmower. As with a lawnmower which is provided with a set of spinning blades for pushing across a lawn to be mowed, the apparatus of the invention is provided with a rotating manifold of spray tubes for pushing across a concrete surface to be cleaned.

To ensure that the spray nozzles are positioned at an optimal height above the surface to be cleaned, the apparatus is provided with a means for setting the height of the nozzles. Further, to allow the manifold to start spinning before the nozzles are positioned near the surface, the apparatus is provided with a lifting means for raising the entire manifold of tubes from the pre-set desired optimal height to a maximum height. With these means, an operator sets the optimal height of the nozzles without any water flowing through the manifold, then raises the manifold to the maximum height before water flow is initiated. After the manifold has an opportunity to start spinning, the operator lowers the manifold to the selected optimal height for cleaning. In this manner, the manifold of nozzles starts spinning before the nozzles are lowered to a position near the surface to be cleaned thereby protecting the surface from possible damage caused by initiating the high pressure flow of water with the nozzles initially stationary and close to the surface to be cleaned.

Although preferably configured with three tubes mounted equidistant around the lower portion of the union, the apparatus is easily reconfigured for using only two tubes. To this end, the lower portion of the union is provided with an extra output aperture spaced midway between a pair of apertures used for mounting two of the tubes of the three-tube configuration. To convert to a two-tube configuration, a pair of the tubes are removed with their apertures plugged, then one of the removed tubes is inserted into the extra aperture, thus yielding a configuration with two tubes positioned diametrically opposite. The two-tube configuration is preferably employed when the source of hot pressurized water does not provide sufficient pressure to operate three nozzles simultaneously.

The apparatus of the invention may conveniently be connected to any of a large number of conventional steam cleaning hot water pressure sources such as those conventionally used to provide a flow of hot pressurized water to a conventional lance or wand. With its lawnmower-type configuration, the apparatus is easily pushed across a surface by an operator without the extreme fatigue occurring with the conventional hand-held lance. Moreover, because an entire swath of concrete is cleaned by the rotating manifold of nozzles, a larger surface area is cleaned much more quickly than with the conventional hand-held lance. By providing nozzles oriented at an angle, rotation of the manifold is achieved solely through the ejection of the hot pressurized water without the need for a separate rotation-generating mechanism. Thus, no separate motor is required for rotating the manifold nozzles.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

FIG. 4 provides a side elevational view, taken along line 4—4, showing the orientation of one spray nozzle.

FIG. 5 is a perspective view of an inside portion of the apparatus of FIG. 1, showing a single nozzle of the rotating manifold passing above a diffuser plate mounted to an inside wall of the apparatus.

FIG. 6 is a side elevational view, partially in cross-section, of the diffuser plate and spray nozzle of FIG. 5.

DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide an apparatus for cleaning hard, flat surfaces such as concrete cement or granite surfaces.

Figure 1:
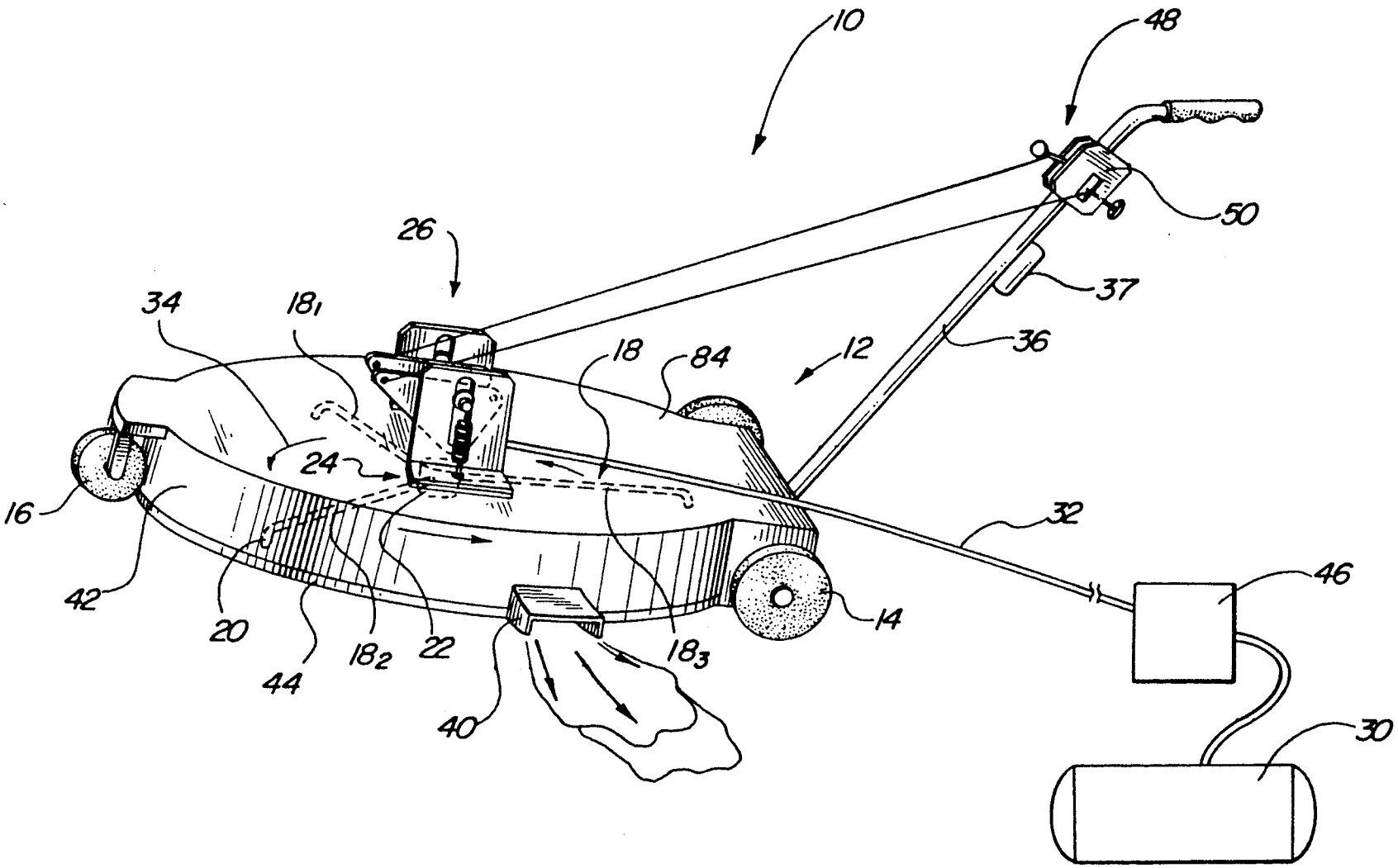
FIG. 1 provides a perspective view, somewhat in schematic form, of a preferred embodiment of the invention with a manifold of spray tube nozzles shown in phantom lines.
Figure 3:
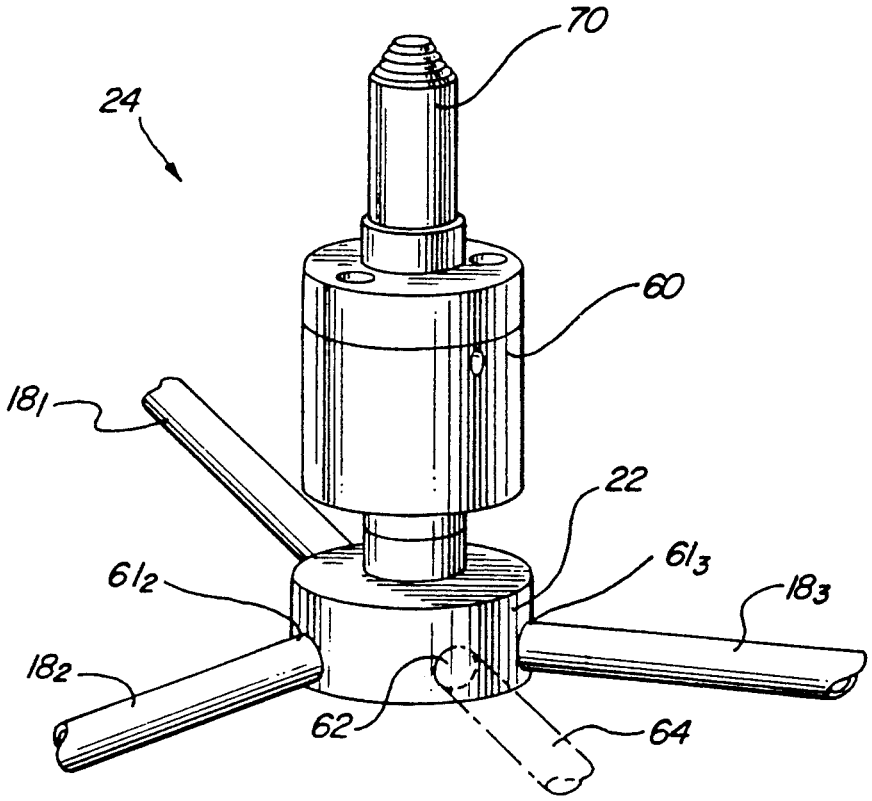
FIG. 3 is a perspective view of a rotating union provided for mounting the manifold of spray nozzles.

Referring first to FIG. 1, a preferred embodiment of the invention will now be described. FIG. 1 provides a perspective view of a pushable cleaning apparatus 10, having a frame or chassis 12 mounted to a set of wheels including a pair of rear wheels 14 and a single front pivoting wheel 16. A manifold of spray tubes 18 is mounted within an interior of frame 12 for rotation therein. Manifold 18 is shown in phantom lines in FIG. 1 and includes three equally spaced spray tubes, individually denoted $\mathbf{18}_1$, $\mathbf{18}_2$ and $\mathbf{18}_3$. A nozzle 20 is provided on an outer end of each of the spray tubes. Each tube of the manifold of tubes 18 is mounted into a lower portion 22 of a rotating union 24. Lower portion 22 is also shown in phantom lines in FIG. 1. An upper portion of union 24, shown more completely in FIG. 3, is fixably mounted into a lift assembly 26. Rotating union 24 and lift assembly 26 will be more fully described below with reference to the remaining FIGURES.

A source 30 of hot pressurized water, such as a conventional steam cleaning apparatus, is utilized with the invention. Hot pressurized water flows through a hose or conduit 32 into the top portion of rotating union 24. The hot pressurized water is conveyed downward toward the union into the lower portion of the union where it is dispersed into each of the three tubes in the manifold of tubes 18. The hot pressurized water is ejected or sprayed through spray nozzles 20 onto a surface to be cleaned. As will be described more fully below with reference to Fig. 4, each of the nozzles is oriented at an angle from the vertical, preferably five degrees, such that water sprayed from the nozzles imparts an angular momentum to manifold 18. Thus, the hot pressurized water sprayed from spray nozzles 20 not only acts to clean a portion of the surface immediately below each nozzle but also causes the manifold to rotate thus carrying each nozzle through an arc. Rotational movement of manifold 18 is indicated by arrows 34. By causing the rotation of manifold 18, each individual nozzle is carried through a 360 degree arc around an inside perimeter of frame or chassis 12 for cleaning a circular or annular portion of the surface to be cleaned.

Apparatus 10 also includes a handle 36 for allowing an operator to push apparatus 10 across the surface to be cleaned. The combination of the rotational movement of nozzles 20 and a forward movement of entire apparatus 10 allows a wide swath of concrete to be easily cleaned. As apparatus 10 is moved slowly across a concrete surface, the ring or annular portion of the concrete cleaned by the rotating nozzles is likewise advanced across the concrete thereby cleaning every square inch traversed by the apparatus 10. Sufficient water pressure is provided by source 30 to accelerate manifold 18 up to 3000 RpM. At this rotational speed, apparatus 10 can be moved fairly quickly across a surface to be cleaned while still allowing individual nozzles 20 to clean every square inch traversed by the apparatus.

Water sprayed from nozzles 20 is ejected from apparatus 10 through a water exit port 40 formed along a vertical side wall 42 of chassis 12. A flexible seal, preferably formed of rubber or like material 44, is provided around substantially the entire perimeter of side wall 42. Seal 44 extends downwardly from a bottom edge of side wall 42 where it touches or brushes the surface which is being cleaned. Seal 44 prevents water from being ejected around the entire periphery of the apparatus and instead forces the water to be ejected only through water exit port 40. As the water sprayed from nozzles 20 may be a temperature of up to 200 degrees, it is particularly important to ensure the ejected water is not ejected in a random direction where it may strike a pedestrian or worker in the vicinity of the apparatus.

A valve 46 may be provided with pressurized hot water source 30 or along hose 32 between the hot pressurized water source and the apparatus, for initiating and terminating a flow of hot water from the hot water source.

Lift assembly 26 in combination with a handle mounted lever 48 allows manifold 18 to be raised or lowered by an operator. Further, lift assembly 26 in combination with a minimum height selection control 50, also mounted to handle 36, allows an operator to select a minimum height of nozzles 20 above the surface to be cleaned. Lift assembly 26 and the handle mounted controls for operating the lift assembly will be described below more fully with reference to FIGS. 7, 8, 9 and 10.

Figure 2:
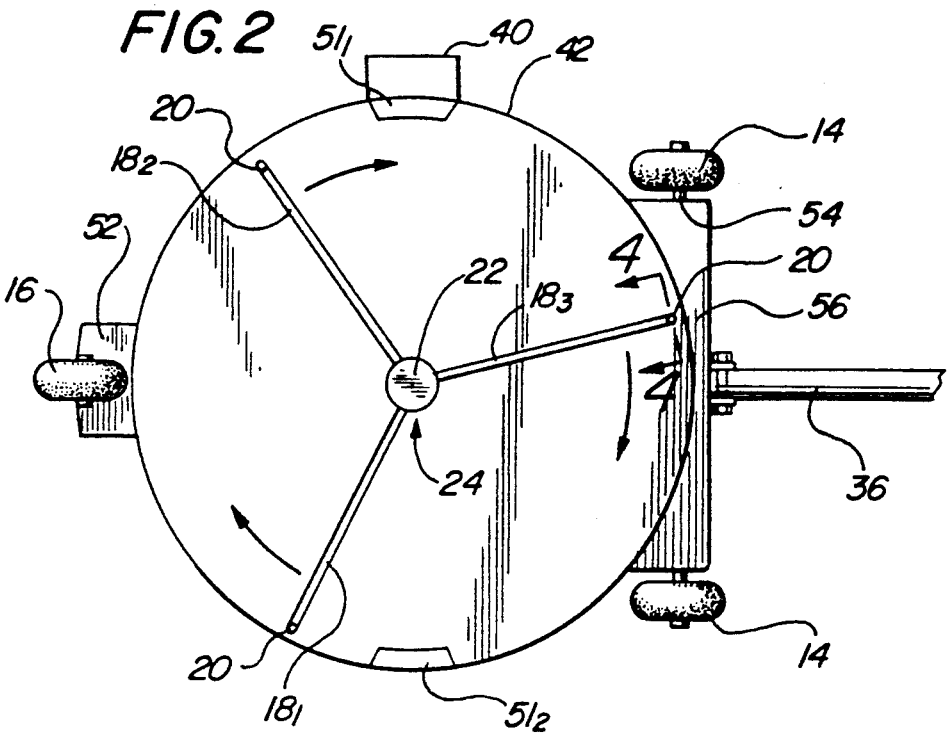
FIG. 2 is a bottom plan view of the apparatus of FIG. 1.

The geometry of manifold 18 is shown more fully in FIG. 2 which provides a bottom plan view of apparatus 10. As can be seen from FIG. 2, each of the tubes of manifold 18 are spaced equally around lower portion 22 of rotating union 24. Each tube is separated by about 120 degrees. Tubes 18 extend radially outwardly from rotating union 24 to positions near an inside surface of side wall 42. A pair of diffuser plates $51_1$, $51_2$ are mounted along opposing, left and right sides of the apparatus. Diffuser plates $51_1$, $51_2$ which will be described in more detail below with reference to FIGS. 5 and 6, deflect water sprayed from nozzles 20 as the nozzles pass above the diffuser plates.

Front pivot wheel 16 is pivotedly mounted to a mounting member 52 which extends outwardly from a front edge of side wall 42. A single front pivoting wheel is provided as it allows apparatus 10 to be more conveniently turned by an operator as the operator pushes the apparatus over a surface. Moreover, the use of a single pivot wheel allows the apparatus to be more easily pushed into a corner to allow easier cleaning of the surface in the vicinity of the corner.

Rear wheels 14 are mounted for rotation about an axle 54 which is mounted within an axle box 56 affixed to a rear outer edge of side wall 42. A base portion of handle 36 mounts onto a rear side wall of axle housing 56. Although a variety of mounting means may be employed, front mounting member 52 and axle housing 56 are preferably welded to vertical side wall 42. Lower portion of handle 36 is preferably bolted onto a mounting member which is welded onto the rear side wall of axle housing 56. A combination of a pair of rear wheels 14 and a single front pivoting wheel 16 provides a stable wheel base for pushing apparatus 10 while also allowing the apparatus to be turned easily and maneuvered into corners.

Referring to FIG. 3, rotating union 24 will now be more fully described. Union 24 includes a lower rotating portion 22 and an upper fixed portion 60. Each tube of manifold 18 is mounted around an outside perimeter of lower portion 22. Tubes 18 extend radially outwardly parallel with the surface to be cleaned. For mounting purposes, a set of three equally spaced threaded bores are provided within the outside perimeter of lower portion 22. Inner ends of tubes 18 are threaded for mounting into the threaded apertures. Care must be taken to ensure that tubes 18 are securely mounted into the apertures. Since the apparatus is designed to operate at water pressures up to 3000 lbs., an inadequately secure mounting of tubes 18 into union 24 may result in water leaking around the inner ends of tubes 18. Moreover, a tube 18 may be explosively dislodged from union 24 if the tube is not securely mounted into the union.

Manifold 18 preferably includes three radially mounted tubes as shown in solid lines. However, if the hot pressurized water source used to supply water cannot provide sufficient water pressure for operating three nozzles simultaneously, apparatus ;0 can be reconfigured to utilize only two nozzles. To this end, an extra bore or aperture 62 is formed within the outer perimeter of lower portion 22 of lower rotating union 24. Extra aperture 62 is formed midway between a pair of apertures $61_2$ and $61_3$ provided for mounting tubes $18_2$ and $18_3$, respectively. By forming extra apertures 62 midway between bore $61_2$ and $61_3$, the extra aperture is diametrically opposite from tube $18_1$. An extra tube 64 is mounted into extra bore 62 to provide a spray nozzle 180 degrees opposite from the spray nozzle of $18_1$. To operate in the two-nozzle mode tube $18_2$ and $18_3$ are removed and aperture $61_2$ and $61_3$ are securely plugged. With aperture $61_2$ and $61_3$ plugged, water flows outwardly only through tube $18_1$ and extra tube 64. Of course, care must be taken to ensure that apertures $61_2$ and $61_3$ are properly plugged. Preferably, apparatus 10 is provided with a total of three tubes. To implement the two-tube system, either tube $18_2$ or $18_3$ is mounted into extra aperture 62. In other words, a total of four tubes need not be provided. To return the apparatus to a three-tube configuration, extra tube 64 is removed aperture 62 and tubes $18_2$ and $18_3$ are returned to aperture $61_2$ and $61_3$. Extra aperture 62 must be securely plugged to enable proper operation of the three-tube manifold.

A pipe 70 extends upwardly from the center of the top surface of upper portion 60 of rotating union 24. Pipe 70 is mounted into lifting assembly 26 as will be described more fully below with reference to FIGS. 7 and 9.

Rotating union 24 must be securely constructed to allow for prolonged use under high pressure with hot water and high rotational speed. Preferably, union 24 is capable of withstanding 3000 lbs. of pressure and a sustained rotational speed of up to 3000 RPMs. Further, the union must be capable of withstanding temperature effects generated both by friction and by the presence of high temperature water, preferably water up to a temperature of about 200 degrees. Heretofore, the only union that the inventor is aware of which is capable of operating at such pressures and temperatures for prolonged periods is provided by the Deublin Company of 1919 Stanley Street, Northbrook, Illinois, and is identified as part number 921-450-416. Of course, if lower spray pressures or rotational speeds are desired, alternative rotating unions may be employed.

Referring to FIGS. 4, 5 and 6, spray nozzle 20 and diffuser plate 51 will now be described. Referring first to FIG. 4, spray nozzle 20 mounts to an underside of tube 18 at an angle from the perpendicular of about 5 degrees. Any variety of suitable nozzles can be employed so long as they can withstand the pressures and temperatures described above and can be securely mounted to tube 18. By providing the 5 degree angle from the vertical, water sprayed outwardly from nozzle 20, shown by arrows 72 imparts a reactive force diametrically opposite from the spray direction on nozzle 20. With tube 18 mounted for rotation only in a plane horizontal to the surface to be cleaned, only a component $F_1$ of reaction force F acts to move the tube 18. Reaction $F_1$ acts upon the outer end of tube 18 to rotate the tube in a plane parallel with the surface to be cleaned. Thus, the slight angle by which nozzle 20 is tilted, in combination with the high pressure output force generated by water sprayed from nozzle 20, acts to spin or rotate manifold of tubes 18 in a plane parallel to the surface to be cleaned. With nozzle 20 tilted at an angle of 5 degrees, and with a water pressure of 3000 lbs., a rotation speed of 3000 RPMs can be achieved. Angles other than 5 degrees can be employed. A greater angle will yield increased rotational acceleration. A lower angle, that is a nozzle oriented more vertically will yield less rotational acceleration but will provide for greater spray force of water sprayed against the surface to be cleaned. Thus, a tradeoff occurs between more efficient angular acceleration or more efficient cleaning force. An angle of 5 degrees has been found to be effective, but other angles between 1 and 45 degrees may also be effective.

Diffuser plate 51, discussed briefly with reference to FIG., 2, is shown more fully in FIGS. 5 and 6. Diffuser plate 51 mounts to an inside surface of side all 42 just 25 above rubber ground seal 44. Diffuser 51 includes a generally horizontal protruding member 80 which extends radially inwardly from side wall 42 to a position underneath the rotational path of nozzle 20. With the nozzle 20 having a minimal height of about ½ inch above the surface to be cleaned, extending portion 80 of diffuser plate 51 is preferably mounted at a height of about ¼ inch. Protruding portion 80 may be a thin, solid metal plate 80 as shown. Alternatively, protruding portion 80 may be perforated with a plurality of holes to allow at leas a portion of water sprayed from nozzle 20, to pass through the diffuser plate.

Diffuser plate 51 is positioned such that water sprayed from nozzle 20 as the nozzle passes above the diffuser plate, is deflected from direct contact with the surface to be cleaned. In FIG. 5 deflected water spray is generally denoted by arrows 82. Diffuser plate 51 is provided to prevent overcleaning of concrete along the left and right sides of a swath of concrete cleaned by apparatus 10. As noted above, as an operator pushes apparatus 10 across the concrete surface, the apparatus acts to clean a wide swath having a width equal to a diameter of manifold 18. However, because the apparatus is moved forwardly, left and right edges of the swath are cleaned more fully than the middle portion of the swath. This occurs because the rotating nozzles spend a greater portion of their time along the left and right edges of the swath than along the middle portions of the swath. As a result, a swath of concrete cleaned by the apparatus without diffuser plates may show uneven cleaning as evidence by a pair of lines or tracks along the left and right side edges of the swath. Further, for surfaces formed of a soft material, damage may occur to the surface along the left and right edges of the swath if too great a water pressure is employed.

The diffuser plates $51_1$, $51_2$ are provided to eliminate these possible problems by deflecting the spray of water sprayed from the nozzles as they pass along the left and right inner side edges of apparatus 10. Diffuser plates $51_1$, $51_2$ extend along inner side edges of side wall 42 by only a limited length, preferably 3 or 4 inches. Since the portions of the surface in front of and behind the diffuser plate are cleaned as the nozzle passes from in front of to behind the diffuser plate, the left and right side portions of the swath concrete are adequately cleaned, but not overcleaned.

Also, because of the high water pressure ejected from the nozzles, it is desirable to be able to select the height at which the nozzles travel above the surface to be cleaned. If the surface is a particularly soft surface, it is desirable to raise the manifold to a height of several inches above the surface such that the high pressure water spray emanated from the nozzles does not damage the surface to be cleaned. For harder surfaces, it is desirable to position the nozzle at a height of ¼ inch above the surface. Further, it is desirable to initiate a flow of water with the nozzles at an elevated height to prevent any damage to the surface to be cleaned. Because the rotation of the manifold is caused solely by the spray of water from the nozzles, when the water flow is initiated, the manifold is stationary. It may take up to 4 seconds to reach useful RPMs. If the nozzles are positioned near the surface to be cleaned, perhaps of a height of ¼ inch, damage to the surface may occur before the nozzles are accelerated to sufficiently fast rotational speed.

Figure 7:
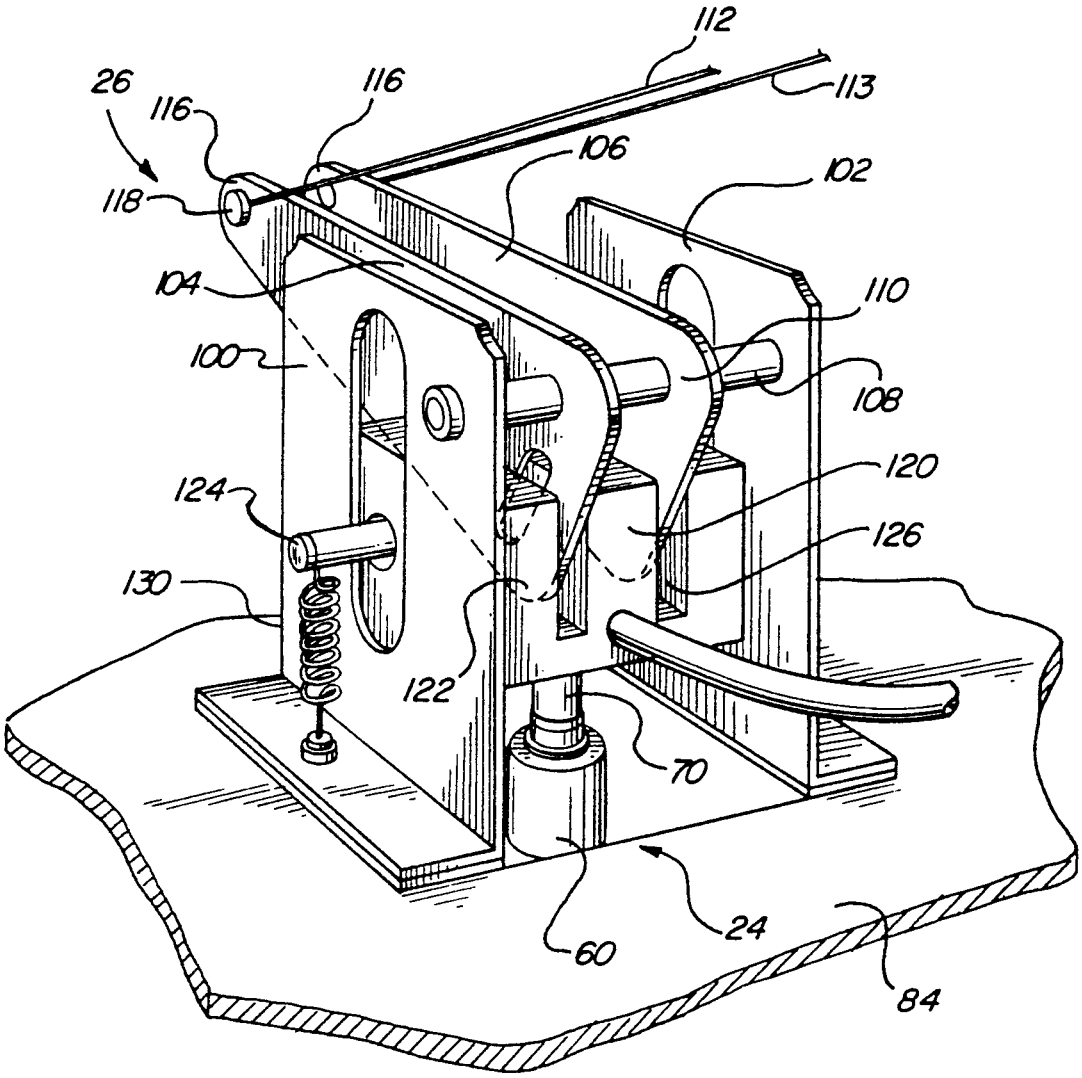
FIG. 7 is a rear perspective view of a lift assembly portion of the apparatus of FIG. 1 providing a close up view of a mechanism provided for allowing the manifold of spray nozzles to be raised or lowered above the surface to be cleaned.

A mechanism for raising and lowering the manifold and setting a minimum height for the manifold will now be described to FIG. 7, 8, 9 and 10. In FIG. 7, a lift assembly 26 is shown, which is mounted over a center portion of top wall 84 of chassis or frame 12. Lift assembly 26 includes a pair of left and right fixed vertical side walls 100 and 102 respectively. Preferably, fixed walls 100 and 102 are sturdy plates of metal securely welded to top wall 84. A pair of left and right generally triangular plates 104 and 106 are mounted between side walls 100 and 102 for pivoting movement therein. To allow pivoting movement, a shaft 108 is mounted perpendicularly through and between fixed walls 100 and 102. Shaft 108 extends through a rear most vertex 110 of each triangular plate. A pair of cables 112 and 114 are mounted to front vertices 116 of each of the triangular plates. Cables 112 and 114 are connected to control levers mounted to the handle of the apparatus, as will be more fully described with reference to FIG. 10. Shaft 118 connects the pair of triangular plates at their front vertixes 116. By pulling upwardly on either cable 112 cable 114, the pair or triangula plates 104 and 106 are pivoted upwardly as a unit about shaft 108.

Upper pipe 70 of rotating union 24 is mounted into a block 120 which is in turn mounted onto a bottom most vertex 122 of each triangular plate. Therefore, as either cable 112 or 114 is pulled, and the triangular plates pivot upwardly as a unit, mounting block 120 is likewise lifted, thereby raising both union 24 and the manifold of tubes 18 mounted thereto.

To mount block 120 to the bottom vertex of the triangular plates, a lift shaft 124 is provided which extends through the bottom vertex of the triangular plates and through a top portion of the mounting block. A pair of slots 126 are formed vertically within the mounting block 120 to provide an aperture for receiving the bottom portion of the triangular plates. Preferably, mounting block 120 extends between vertical side plates 100 and 102 such that the mounting block is snugly mounted between the fixed vertical plates. Further, slots 126 are preferably sized for closely receiving the triangular plates such that the plates are snugly received within the mounting block. With this configuration, the entire lift assembly is fairly sturdy and the triangular plates do not tilt unnecessarily to the left or right as they are pivoted upwardly or downwardly.

A pair of springs 130 are provided on opposing outside edges of the vertical mounting plates. Each spring 130 is mounted both to top wall 84 of the chassis and to lift shaft 124. Springs 130 bias lift shaft 124 downwardly thereby also biasing the of the front vertices of the triangular plate downwardly. Thus, absent a mechanism for location, the triangular plates in an upwardly pivoted pull the triangular plates downwardly thereby lowering the rotating manifold to its lowest height. However, as will be described with reference to FIG. 10, a mechanism for locking one of the lift cables is provided.

Figure 8C:
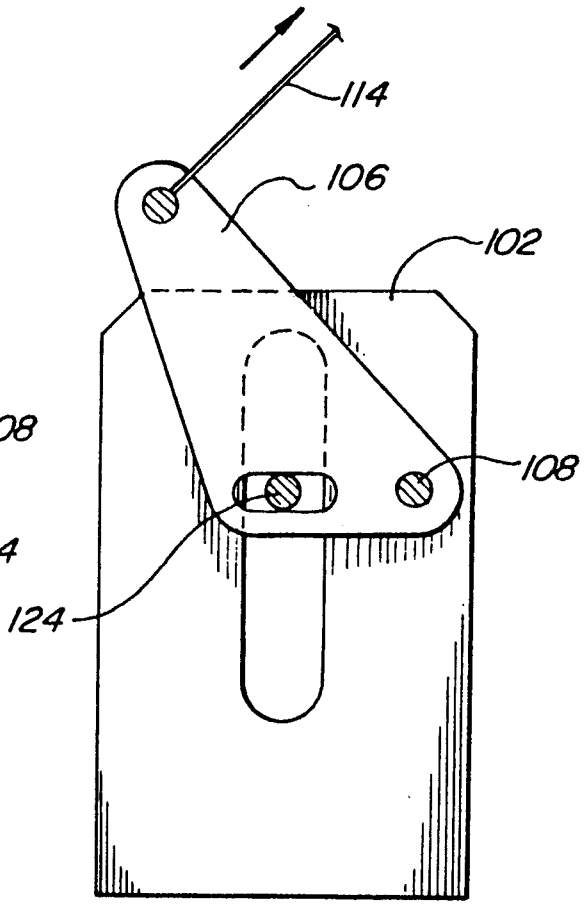
FIG. 8*c* is a side view, partially in cross-section, showing one of a pair of triangular plates of the lift assembly of FIG. 7 oriented in an maximum height configuration, corresponding to a maximum height of the manifold spray nozzles.
Figure 8B:
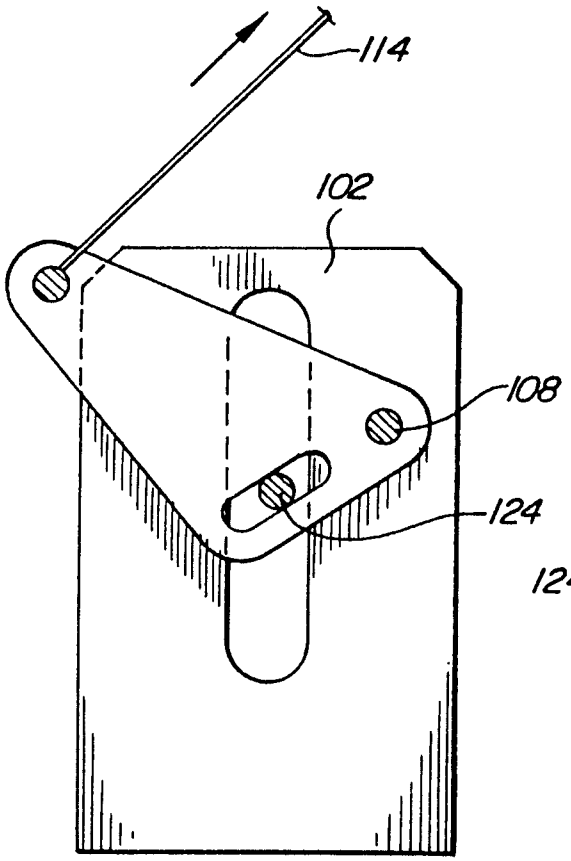
FIG. 8*b* is a side view, partially in cross-section, showing one of a pair of triangular plates of the lift assembly of FIG. 7 oriented in an intermediate height configuration, corresponding to a intermediate height of the manifold spray nozzles.
Figure 8A:
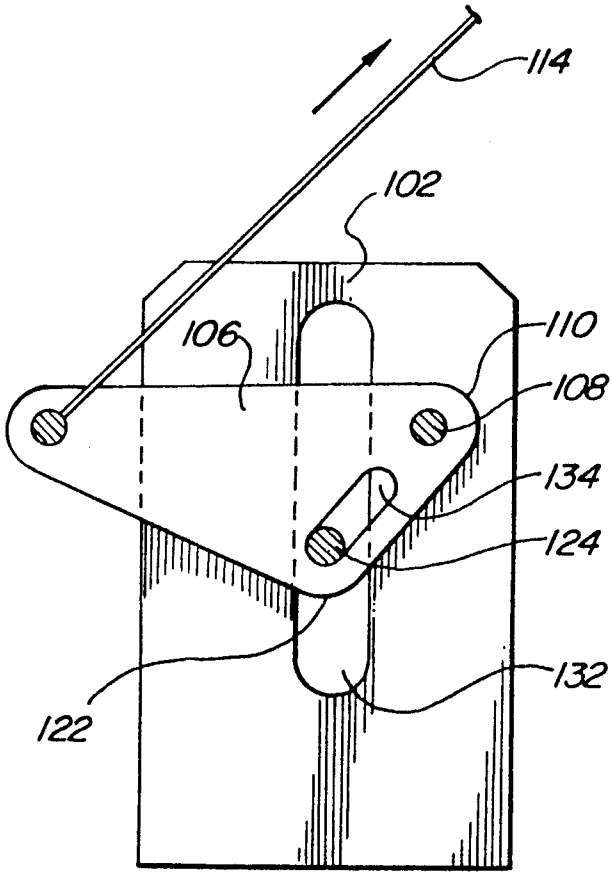
FIG. 8*a* is a side view, partially in cross-section, showing one of a pair of triangular plates of the lift assembly of FIG. 7 oriented in a minimum height configuration, corresponding to a minimum height of the manifold spray nozzles.

The pivoting movement of the triangular plates is shown most clearly in sequence in FIGS. 8*a* through 8*c*. In FIG. 8*a*, triangular plate 106 is shown in a downwardly tilted position, corresponding to a minimum height of the manifold. FIG. 8*c* illustrates triangular plate 106 pivoted upwardly to a maximum height position of the rotating manifold. FIG. 8*b* illustrates the triangular plate in an intermediate height position. As can be seen from these FIGURES, lift shaft 124 is disposed within a vertical slot 132 formed within side plate 102. Similarly, lift shaft 124 is also disposed within a vertical slot within side plate 100. Further, lift shaft 124 is disposed within a shorter slot 134 formed parallel with a side edge of triangular plate 106 and extending substantially from lower vertex 122 to rear vertex 110 of the triangular plate. Similarly, lift shaft 124 is also disposed within a shorter slot formed parallel with the side edge of triangular plate 104. In the lower-most configuration, lift shaft 124 is positioned both near a bottom portion of slot 132 and a bottom portion of slot 134. As either or both, are lift cables 112, are raised, and the triangular plate is pivoted upwardly, lift shaft 124 traverses slots 132 and 134 to lie closer to opposing ends of those slots. With this mechanism, the rotational pivoting movement of the triangular plate is converted to a purely vertical movement of the lift shaft 124. As noted above, the manifold of spray nozzles is connected via the rotating union and the mounting block into the lift shaft such that any vertical movement of the lift shaft yields a corresponding vertical movement of manifold of nozzles.

Figure 9:
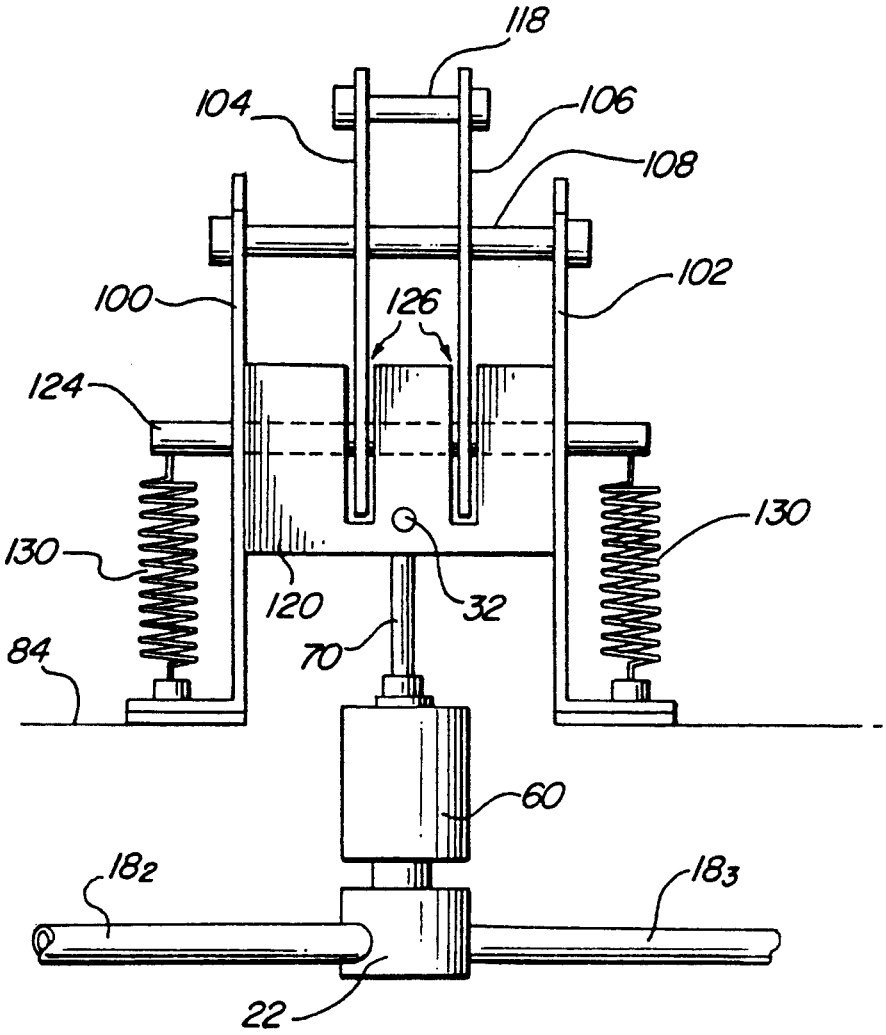
FIG. 9 is a rear elevational view, partially in cross-section, of the lift assembly and spray manifold of FIG. 1, particularly illustrating a rotation union which mounts the manifold of spray nozzles to the lift assembly.

FIG. 9 provides a rear view of the lift assembly, the rotating union and inner portions of the manifold of spray nozzles.

Figure 10:
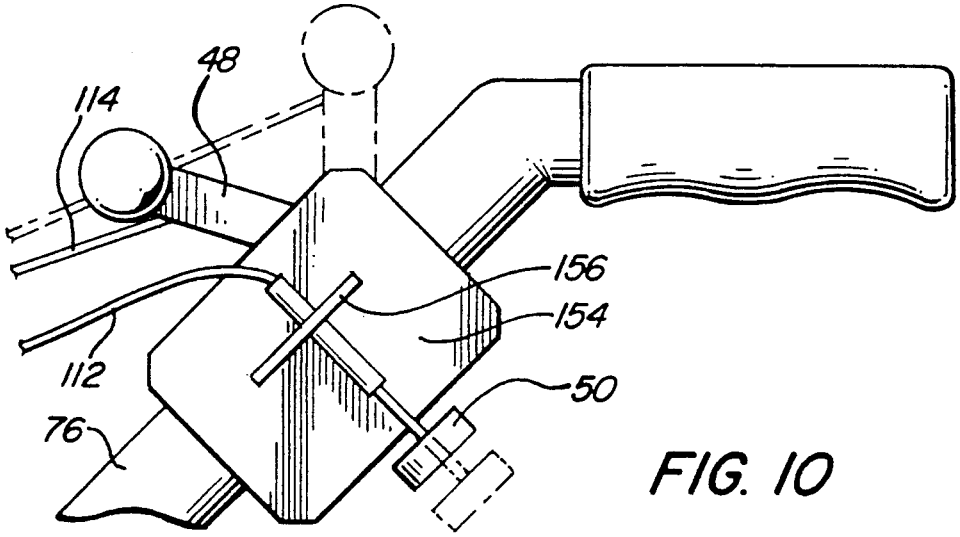
FIG. 10 is a side elevational view of a top portion of the handle of the apparatus of FIG. 1, particularly illustrating controls for raising and lowering the manifold of spray tubes and for setting a minimum height of the manifold of spray tubes.

FIG. 10 provides a side view of the levers and mechanisms provided on the handle of the apparatus for retracting or lengthening cables 112 and 114 to correspondingly raise or lower the manifold of spray tubes. A right lift cable 114 is connected from the right triangular plate 106 to a lift lever 48. Lift lever 48 may be raised from a lower forward position (shown in solid lines) to an upper rearward position (shown in phantom lines). By pivoting lift lever 48 as shown, right lift cable 114 is retracted thereby pivoting the pair of triangular plates upwardly and raising the manifold of spray nozzles.

To set a minimum height of the manifold of spray nozzles, a lockable, height setting knob 50 is employed. Height setting knob 50 is mounted to an opposing side of handle 36 from that of lift lever 48. Preferably, a flat metal plate 154 is mounted to a side surface of handle 36. A perpendicular plate 156 extends outwardly from side plate 154. Left cable 112 mounts into the plate 156. Lockable knob 152 is configured to allow cable 112 to be retracted through plate 156 and then locked at a retracted position. Locking knob 152 may be any one of a variety of cable-locking mechanisms such as those found in conventional choke locking mechanisms. In use, such a knob is rotated to unlock the cable then pulled rearwardly to further retract the cable, then rotated it again to lock the cable in the retracted position. With the capability of locking left cable 112 in a retracted position, an operator can lock the minimum height of the manifold of spray nozzles. In other words, with cable 112 locked in a retracted configuration, the triangular plates of lift assembly 26 are locked in an upwardly pivoted position. Such as the intermediate position shown in FIG. 8*b*. With the triangular plates locked at an intermediate upwardly pivoted position, the manifold of spray tubes is likewise locked at a position above its minimum height position. Thereafter, movement of lift lever 48 merely acts to raise the manifold of spray nozzles from the selected minimum, height to a maximum height. By shifting the lift lever 48 forward, the manifold of spray tubes is only lowered to the pre-selected minimum height. The manifold of spray nozzles can only be lowered below that selected minimum height by releasing the locking knob 50.

Thus, lift assembly 26 and the controls provided on the handle of the apparatus, together enable the lift manifold of spray tubes to be raised or lowered and to enable a minimum height of the spray tubes to be selected. As noted above, the ability to set the minimum height is particularly desirable since surfaces to be cleaned may be of differing hardnesses which require a different nozzle height. A soft surface of a damageable material should be cleaned by setting the nozzles relatively high above the surface so that high pressure water spray ejected from the nozzles does not damage the soft surface. For such surfaces, the minimum height of the nozzles should be set to 2 or 2½inches as desired. For harder surfaces, the spray nozzles may be positioned much closer to the surface, such as a height of approximately ½ inch. Furthermore, selection of a minimum height is desired to compensate for any upwardly extending joints which may be formed in the surface which is being cleaned. If such joints protrude upwardly more than ½ inch above the surface, the minimum height of the spray nozzles should be set to a correspondingly higher height to prevent damage of the nozzles caused by impact of the nozzle with the upwardly protruding joint.

The lift lever 58 enables the nozzles to be raised to their maximum height when a flow of water is to be initiated. As noted above, it may be damaging to some surfaces to initiate water flow with the nozzles close to the surface because it may take some time before the nozzles accelerate to full rotational speed. While the nozzles are slowly rotating, a high pressure spray or blast of water from a nozzle positioned close to the surface may damage the surface. Thus, to initiate cleaning, the minimum height of nozzles is set without any water flowing through the nozzles. This is accomplished sing knob 50. Once a desired height is set, lift lever 48 is pivoted rearwardly to raise the manifold of nozzles to its maximum height at which time the flow of water is initiated, perhaps by activating valve 46. Once water begins to flow into the apparatus where it is sprayed downwardly from the nozzles, the manifold of tubes begin to rotationally accelerate. After a period of time, typically 4 to 6 seconds, the manifold of nozzles reaches its maximum rotational speed, of up to 3000 RPM. Once the manifold of nozzles is rotating quickly, it can be lowered using lift lever 48 to begin full cleaning of the surface. The operator of the apparatus then pushes the apparatus across the surface to be cleaned, much in the same manner in which an operator pushes a lawnmower across the surface to be mowed. The operator need not maintain a constant pace but instead may pause over portions of the surface which need particular cleaning.

Although not shown in the FIGURES, a gauge may be provided in conjunction with the lift assembly for showing the operator the height of the manifold of nozzles. This may be accomplished by providing an arrow on one of the triangular plates which points to a set of indicia formed on an outside surface of one of the four vertical plates. The indicia are preferably calibrated such that the arrow points to a marker indicating the height of the nozzles, typically a range of ½ to 2½ inches.

Figure 11:
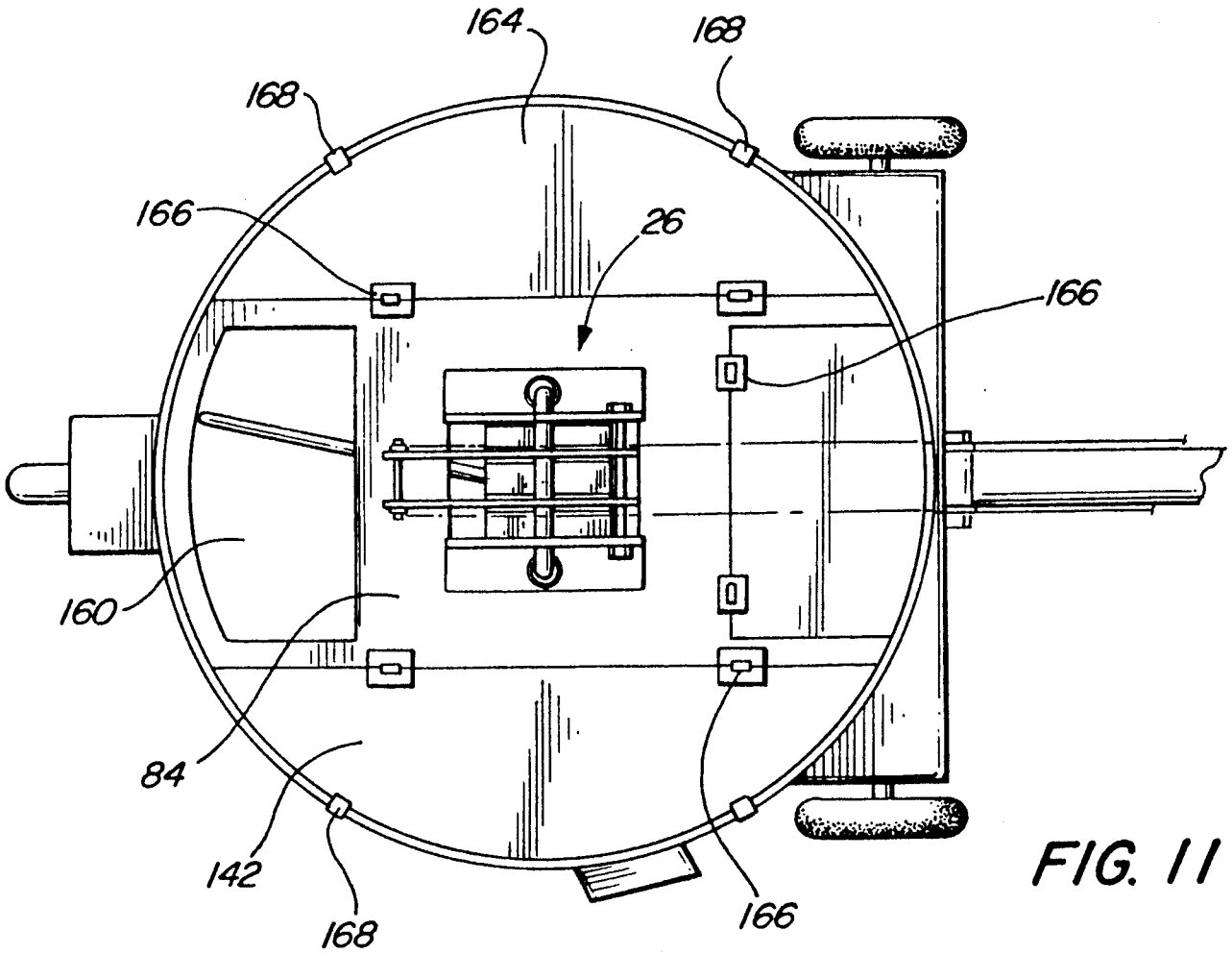
FIG. 11 is a top plan view of a preferred embodiment of the apparatus of FIG. 1, particularly illustrating a transparent window provided in the frame of the apparatus for allowing an operator to see a surface as it is cleaned and also particularly illustrating a set of hinges provided for allowing portions of the top wall of the frame to be pivoted upwardly for allowing access to the interior of the apparatus by an operator.

Referring to FIG. 11, a top view of a preferred embodiment of apparatus 10 is illustrated. As can be seen, top wall 84 of chassis 12 is provided with a forward transparent window 160 provided to allow an operator to watch the operation of the rotating nozzles to conveniently verify the surface is being cleaned. Top wall 84 is also provided with left and right pivotable panels 162 and 164 respectively. A set of hinges generally denoted 166 are provided for allowing the plates to be pivoted upwardly until approximately vertical. By providing pivotal plates, an operator can gain easy access to the interior of the apparatus. A set of clasps 168 are employed for holding the pivoting plates down onto top wall 84 while the device is in use. Additionally, a rear pivoting plate, 170 may be provided immediately rearward of lift assembly 26 for providing access to a rear portion of the interior of the apparatus. A set of hinges and clasps are likewise employed.

What has been described is an apparatus for cleaning hard, flat surfaces such as concrete surfaces, parking lots, plazas and sidewalks. The apparatus receives a flow of hot pressurized water and sprays the hot water downwardly onto a surface through a manifold of rotating spray tubes. The apparatus is mounted to a set of wheels and is provided with a handle such that it can be easily pushed by an operator across the surface to be cleaned. In this manner, the apparatus is used in much the same manner as one would operate a lawnmower, i.e., by pushing the apparatus back and forth across the surface to be cleaned, with each pass cleaning a wide swath of the surface.

A mounting shaft 37 (FIG. 1) is provided on the handle 36 to allow a conventional lance or wand to be carried with the apparatus on the handle. Thus, if there is a need to clean a portion of the surface which cannot be easily cleaned by the apparatus, such as the inner most portion of a corner, or set of stairs, the apparatus can be disconnected from the water source, and the conventional lance or wand utilized to clean the desired portion. Once the hard to reach portion of the concrete is cleaned, the conventional lance or wand is disconnected from the water source, and the apparatus of the invention is reconnected.

Apparatus 10 can operate at water temperatures between ambient temperature and 250 degrees with a water pressure of up to 3000 lbs. At 3000 lbs., the manifold of tubes spins at up to 3000 RPM depending upon the angle of the nozzles. Typically, the apparatus receives water flow of about 5–7 gallons per minute. Although the apparatus can be constructed of various sizes, it is preferred that the manifold of tubes has an overall diameter of about 29 inches and a height range of between ½ and 2½ inches. With these various operational parameters, it has been found that the apparatus can effectively clean approximately 6000 sq. feet per hour, depending upon the amount of grime whereas a conventional lance or wand cleaning system may be able to effectively clean only 2000 sq. feet per hour. Moreover, because of fatigue, the operator of a conventional lance will only clean about 10000 sq. feet in an 8 hour shift. With the apparatus of the invention, 20000–40000 sq. feet can be effectively cleaned in a single 8 hour shift.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. An apparatus for cleaning a hard, flat surface, comprising:

moveable cart;

union means for receiving a flow of pressurized water and for conveying said flow of water into a plurality of tubes, said union means having an upper portion fixedly mounted to said cart and a lower portion rotatably connected to said upper portion for rotation about a vertical axis, said tubes being mounted to said rotatable lower portion for rotation therewith in a plane parallel with a surface to be cleaned;

nozzles, mounted to said tubes, for directing said flow of water downwardly from said tubes toward said surface for cleaning said surface; said nozzles being tilted at an angle from said vertical axis whereby water sprayed from said nozzles at said angle from said vertical axis causes said tubes to rotate about said union;

vertical displacement means for vertically displacing said union and said tubes, whereby a distance between the nozzles and the surface to be cleaned is adjustable;

minimum height selection means for setting a desired nozzle height; and water flow valve means on a tube connecting said union means to a source of pressured water for suspending said flow of water to said union means, whereby said water flow may be deactivated by said valve, said height of said nozzles set using said minimum height selection means and said nozzles raised using said vertical displacement means, with said water flow reactivated to initiate rotation of said tubes before said nozzles are lowered to said desired nozzle height for cleaning said surface;

said minimum height selection means and said vertical displacement means being actuable from a top portion of a handle which is mounted to, and extends upwardly from, a rear portion of said moveable cart.

2. The apparatus of claim 1, wherein said movable cart includes a body having substantially enclosed top and side walls with a downward facing opening and wherein, at least, said lower portion of said union means and said tubes are mounted within an interior of said body.

3. The apparatus of claim 1, wherein said top wall is substantially circular, said downward facing opening is substantially circular, and said side walls are vertical cylindrical walls.

4. The apparatus of claim 3, wherein said tubes extend radially outward from said lower portion of said union means, said tubes having outward ends positioned near an inner surface of said side walls of said body.

5. The apparatus of claim 2, wherein portions of the top wall of the body of said moveable cart are hingeably mounted to enable access to said interior of said body.

6. The apparatus of claim 2, wherein a water outlet channel is formed along the side wall of the body for channeling water sprayed from said nozzles out from the interior of said body.

7. The apparatus of claim 2, wherein a pair of diffuser plates are mounted to interior side walls of said nozzles are passing said left or right sides, said diffuser plates partially deflecting said spray of water away from a surface beneath said left and right sides of said body.

8. The apparatus of claim 2, wherein a peripheral flexible flange extends downwardly from a lower edge of said side wall of said body by an amount sufficient to touch said surface to be cleaned, said flange substantially preventing said water sprayed from said nozzles from escaping around the entire periphery of the lower edge of said side wall.

9. The apparatus of claim 8, wherein an outlet channel is formed from a gap provided in said peripheral flange and a gap is provided in a portion of said side wall of said body adjacent to said gap of said flange, said gaps together providing a single opening.

10. The apparatus of claim 1, wherein a top wall of a body of said moveable cart includes a substantially transparent portion to allow viewing of said surface as it is cleaned.

11. The apparatus of claim 1, wherein a body of said moveable cart includes a pair of rear wheels and a single front wheel, said wheels supporting said body above a flat surface to be cleaned.

12. The apparatus of claim 11, further including a handle extending upwardly from a rear portion of said moveable cart for facilitating manual pushing of said cart across said surface to be cleaned.

13. The apparatus of claim 12, wherein a mounting shaft is attached to said handle, said shaft being sized for receiving and holding a spray lance whereby a connecting tube which connects said union means to a water pressure source can be detached from said union means attached to said lance for manually cleaning corners and edges of said surface or for cleaning surfaces which are not sufficiently flat.

14. The apparatus of claim 14, wherein said plurality of tubes consists of three equally spaced tubes.

15. The apparatus of claim 14, wherein detachable mounting means are provided for alternatively mounting three equally spaced tubes or two diametrically opposing tubes to said union means.

16. The apparatus of claim 15, wherein the tubes are detachably mounted into outlet apertures in the lower portion of the union means, with three apertures 120 degrees apart provided for mounting three equally spaced tubes, and wherein an extra outlet aperture is provided midway between two of the three apertures, said extra aperture being plugged when three tubes are attached to said three apertures, said two apertures adjacent to said extra aperture being plugged when a single tube is mounted to said extra aperture.

17. The apparatus of claim 1, wherein each of said nozzles is angled downwardly from a respective tube at an angle of between one and ten degrees from the vertical.

18. The apparatus of claim 17, wherein said nozzles are angled at substantially 5 degrees from the vertical.

19. An apparatus for cleaning a hard, flat surface, comprising:

moveable cart;

union means for receiving a flow of pressurized water and for conveying said flow of water into a plurality of tubes, said union means having an upper portion fixedly mounted to said cart and a lower portion rotatably connected to said upper portion for rotation about a vertical axis, said tubes being mounted to said rotatable lower portion for rotation therewith in a plane parallel with a surface to be cleaned;

nozzles, mounted to said tubes, for directing said flow of water downwardly from said tubes toward said surface for cleaning said surface; said nozzles being tilted at an angle from said verticle axis whereby water sprayed from said nozzles at said angle from said vertical axis causes said tubes to rotate about said union; and vertical displacement means for vertically displacing said union and said tubes, whereby a distance between the nozzles and the surface to be cleaned is adjustable, the vertical displacement means further comprising:

a pair of vertical side plates extending upwardly from a top wall of a body of said moveable cart;

a pair of vertical triangular plates disposed between said vertical side plates; each having a first, a second and a third vertex, the vertical triangular plates being connected together;

a pivot shaft extending through a pair of bores formed in said vertical side plates and through bores formed in said first vertex of each triangular plate, said triangular plates being free to pivot as a unit about said pivot shaft;

means for pivoting said triangular plates about said pivot shaft;

a lift shaft extending horizontally through a pair of vertical slots formed in the vertical side plates and extending through a guide slot formed in each triangular plate, said lift shaft being displaced vertically corresponding to a pivoting movement of said triangular plates; and means for mounting said lift shaft to said upper portion of said union means whereby pivoting movement of said triangular plates yields a corresponding vertical displacement of said union means; and minimum height selection means for setting a desired nozzle height; and water flow valve means on a tube connecting said union means to a source of pressurized water for suspending said flow of water to said union means, whereby said water flow may be deactivated by said valve, said height of said nozzles set using said minimum height selection means and said nozzles raised using said vertical displacement means, with said water flow reactivated to initiate rotation of said tubes before said nozzles are lowered to said desired nozzle height for cleaning said surface;

said minimum height selection means and said vertical displacement means being actuable from a top portion of a handle which is mounted to, and extends upwardly from, a rear portion of said moveable cart.

20. The apparatus of claim 19, wherein, said means for mounting the lift shaft to the union means comprises:

a mounting block connected to said lift plate, said mounting block having an internal channel for conveying pressurized water from a side surface of the block to a bottom surface of the block; and a pipe having a top end threaded into an outlet aperture of the channel formed on the bottom surface of the block and having a bottom end threaded into a bore formed in the top portion of the union means; whereby pressurized water received by said mounting block through an inlet aperture of the block formed on the side surface of the channel is conveyed through the channel, down the pipe and into the top portion of the union means.

21. The apparatus of claim 19, wherein said means for pivoting the triangular plates comprises a lift cable affixed to a second vertex of one of said triangular plates and extending to a handle of said moveable cart, said cable being pulled toward the handle to pivot the triangular plates.

22. An apparatus for cleaning a hard, flat surface, comprising:

means for generating a flow of hot, pressurized water;

a body with a bottom opening;

wheels supporting said body above a flat surface to be cleaned by a certain height;

a union mounted to an interior surface of said body, said union having an upper portion fixed to said body and a lower portion rotable with respect to said upper portion and said body;

three equally spaced tubes extending radially outward from said lower portion of said union, said tubes being mounted substantially parallel to said surface to be cleaned, said tubes having outward ends positioned near an inner side surface of said body;

a nozzle mounted to the outward end of each tube, the nozzle being angled downwardly from said tube at an angle of between one and ten degrees from the vertical;

a conduit connecting said means for generating a flow of water to said upper portion of said union, whereby a flow of water is directed, sequentially, through said conduit, said union, said tubes, and said nozzles to spray said surface to be cleaned, said nozzles being angled whereby said spray of water from said nozzles causes rotation of said tubes and said lower portion of said union;

vertical displacement means connecting to said union for vertically displacing said union, whereby the distance between the nozzles and the surface to be cleaned is selectable;

minimum nozzle height selection means for setting a minimum desired nozzle height; and a water flow valve mounted to said conduit, whereby said water flow may be deactivated, said height set, and said nozzles raised, and whereby said water flow may be reactivated to initiate rotation, before said nozzles are lowered to said desired height.

23. An apparatus for cleaning a hard, flat surface, comprising:

a moveable cart including a rear portion;

a handle mounted to said rear portion and extending upward therefrom, the handle including a top portion;

union means for receiving a flow of pressurized water, the union means including an upper portion mounted to said cart, a lower portion rotatably connected to the upper portion, and a plurality of tubes attached to and radially directed outward from the lower portion in a plane parallel with a surface to be cleaned, the upper portion, the lower portion, and the plurality of tubes defining a path through which said flow of water sequentially passes and from which said flow of water is dispensed for cleaning said surface; and vertical displacement means actuable from said top portion for vertically displacing said union means, whereby a distance between said plurality of tubes and said surface to be cleaned is adjustable.

24. An apparatus for cleaning a hard, flat surface, comprising:

a moveable cart including a rear portion;

a handle mounted to said rear portion and extending upward therefrom, the handle including a top portion;

union means for receiving a flow of pressurized water, the union means including an upper portion mounted to said cart, a lower portion rotatably connected to the upper portion, and a plurality of tubes attached to and radially directed outward from the lower portion in a plane parallel with a surface to be cleaned, the upper portion, the lower portion, and the plurality of tubes defining a path through which said flow of water sequentially passes and from which said flow of water is dispensed for cleaning said surface; and lifting means actuable from said top portion for vertically displacing said union means and for setting a desired minimum height between said plurality of tubes and said surface, whereby said water flow to said union means may be deactivated, said union means raised and the desired minimum height set using the lifting means, and whereby said water flow may be reactivated before said union means is lowered to the desired minimum height for cleaning said surface.

* * * * *